United States Patent [19]

Annovi

[11] Patent Number: 4,631,843

[45] Date of Patent: Dec. 30, 1986

[54] REAR-ENTRY SKI BOOT

[75] Inventor: Giuseppe Annovi, Montebelluna, Italy

[73] Assignee: Dolomite S.p.A., Treviso, Italy

[21] Appl. No.: 758,319

[22] Filed: Jul. 24, 1985

[30] Foreign Application Priority Data

Aug. 6, 1984 [IT] Italy ..... 84120 A/84

[51] Int. Cl.[4] ..... A43B 5/04; A43B 7/14; A43B 19/00

[52] U.S. Cl. ..... 36/119; 36/71; 36/93

[58] Field of Search ..... 36/117–121, 36/71, 93, 88, 89, 105, 3 R

[56] References Cited

U.S. PATENT DOCUMENTS 3,664,043 5/1972 Polumbus, Jr. ..... 36/71
4,232,459 11/1980 Vaccari ..... 36/71
4,420,893 12/1983 Stephan ..... 36/117 X

FOREIGN PATENT DOCUMENTS 2321817 11/1973 Fed. Rep. of Germany ..... 36/3 R
2316014 11/1973 Fed. Rep. of Germany ..... 36/71
2456612 6/1975 Fed. Rep. of Germany ..... 36/93
3310812 9/1984 Fed. Rep. of Germany ..... 36/117
2496423 6/1982 France ..... 36/117

*Primary Examiner*—James Kee Chi
*Attorney, Agent, or Firm*—Charles W. Fallow; Martin P. Hoffman; Mitchell B. Wasson

[57] ABSTRACT

The rear-entry ski boot disclosed herein includes a substantially rigid outer foot portion and a relatively movable leg portion, the foot portion having an inner lining with at least one inflatable air pocket interposed between the foot portion and the inner lining. A pump operable by bending movements of the leg portion is provided for inflating the air pocket.

10 Claims, 2 Drawing Figures

REAR-ENTRY SKI BOOT

BACKGROUND OF THE INVENTION

This invention relates to a rear-entry ski boot.

Rear-entry ski boots are known in which each boot is not open at its front but instead is provided with a rear opening in the leg portion to allow entry of the skier's foot. Such boots seem particularly suitable for satisfying current skiers' requirements, and for this reason they are becoming increasingly more available commercially.

In known rear-entry boots, there is usually provided between the foot portion and the inner boot lining a presser member which acts vertically on the skier's foot in order to force it against the boot insole. This presser member can be of a type adjustable from the outside by screw devices or other means.

However, such boots have certain drawbacks. In particular, they exert a localized gripping action which, after a short time, can cause pain that can be withstood by the skier only for limited period or with considerable discomfort. Furthermore, the donning or removal of the boot is frequently laborious in that the screw adjustment device has to be manipulated in order to operate the presser member.

In order to obviate these drawbacks, ski boots have been proposed in which the presser member comprises an air pocket interposed between the foot portion of the boot and the inner lining, the pocket being inflatable by means of a manually operated pump provided on the foot portion.

Such known boots have, however, the drawback of requiring a certain effort from the user who is compelled to kneel, operate the pump in order to inflate the pocket, stand up again, and check that the required degree of grip has been attained, failing which the operations have to be repeated.

SUMMARY OF THE INVENTION

All of the drawbacks noted above are avoided according to the invention by a rear-entry ski boot comprising at least one inflatable air pocket interposed between the foot portion and the inner lining boot and a pump for inflating the pocket which pump is automatically operable by the bending movements of the leg portion of the boot so as to feed air into the pocket.

One object of the invention is to provide a rear-entry ski boot with a particularly comfortable presser member.

Another object is to facilitate the application and removal of a rear-entry ski boot.

A further object is to provide a rear-entry ski boot which adjusts automatically to the wearer's foot without undue manipulations on his part.

BRIEF DESCRIPTION OF THE DRAWINGS

A preferred embodiment of the invention is described by the following detailed description which should be taken in conjunction with the accompanying drawings, wherein.

DESCRIPTION OF A PREFERRED EMBODIMENT

Figure 1:
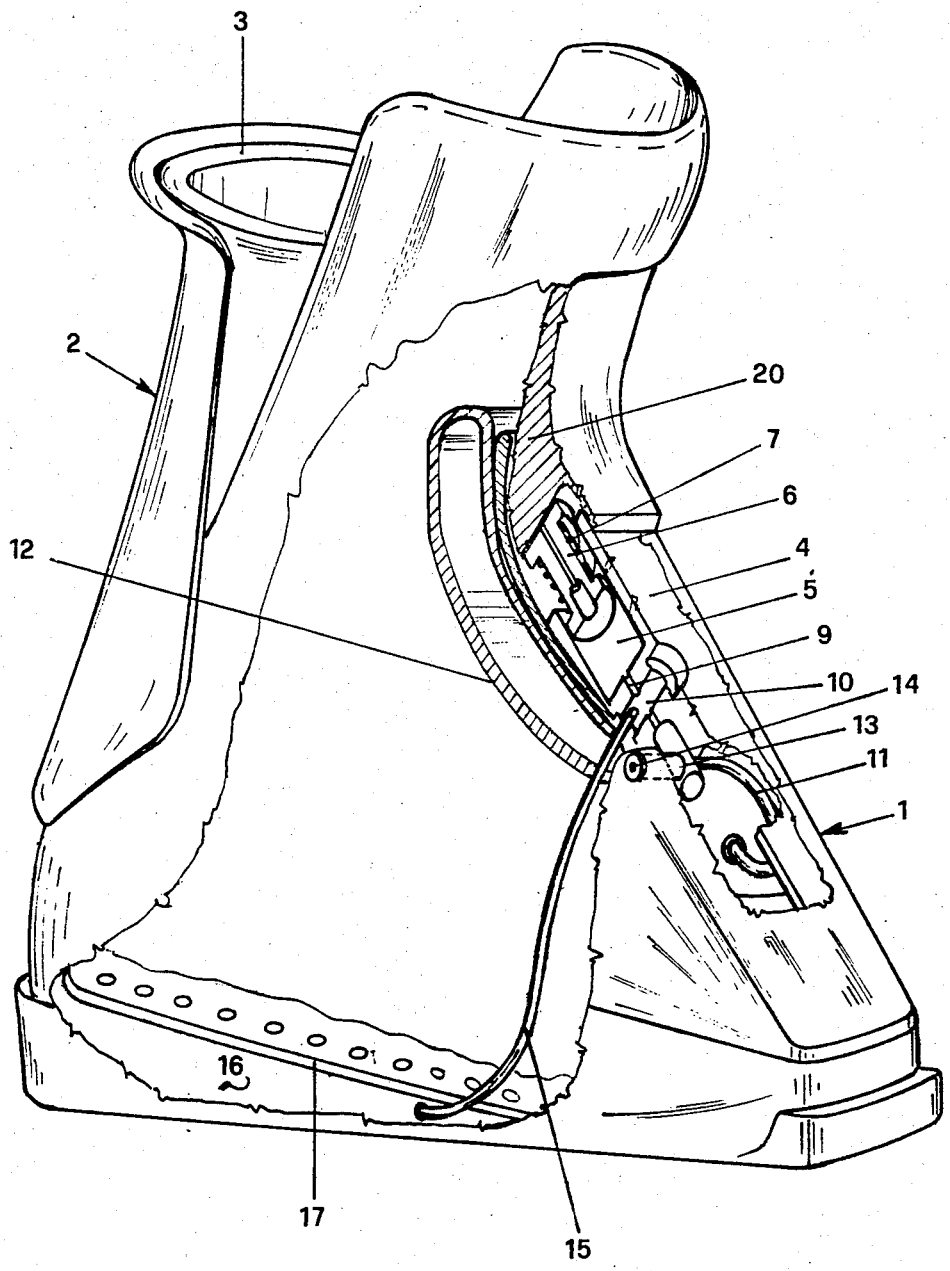
FIG. 1 is a perspective view of a ski boot, in partial section, according to the invention.
Figure 2:
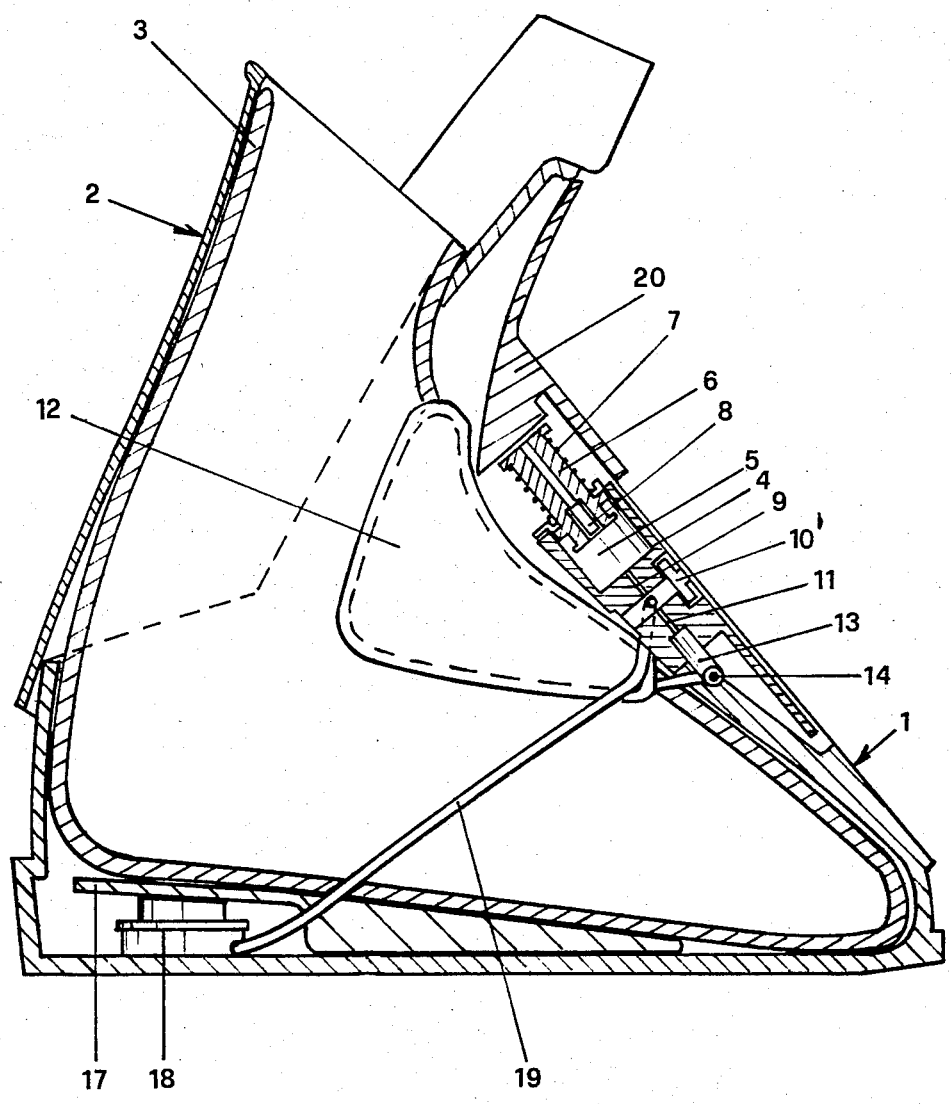
FIG. 2 is a sectional view taken along a vertical plane laterally bisecting the boot.

With reference to FIGS. 1 and 2, a rear-entry ski boot embodying the invention comprises a rigid foot portion 1 with a leg portion 2 hinged to it, both the foot portion and the leg portion being constructed of injection molded plastic material and providing a rear aperture therebetween for entry of the user's foot. An inner lining 3 of spongy material is disposed inside the foot portion 1.

Within the foot portion 1 is a block or housing 4 defining therein a cylinder 5 containing therein a reciprocable piston 6 surrounded by a return spring 7, as shown. The piston contains a check valve 8 and is positioned within the foot portion 1 near the instep thereof. The interior of the cylinder 5 is connected by a duct or passage 9 to a three-way valve 10 having two outlets. One of these outlets is connected by means of a tube 11 to an inflatable pocket 12 interposed between the foot portion 1 and thSe inner lining 3 in a position just below the block 4. In the tube 11 there is a discharge valve 13 operable via pushbutton 14 which emerges to the outside of the foot portion 1 as shown in FIG. 1.

The other outlet of the three-way valve 10 is connected by a second tube 15, running laterally between the inner lining 3 and the foot portion 1 to a cavity 16 defined between the foot portion 1 and the insole 17, which insole is perforated for reasons described hereafter.

The leg portion 2 is provided internally with a shoulder 20 having a portion facing the exposed end of the piston 6.

In operation, after the skier has inserted his foot into the foot portion 1 and has manually closed the boot, he manipulates the valve 10 to connect the cylindrical chamber 5 to the air pocket 12. He then repeatedly bends his leg so that the shoulder 20 is forced by the leg portion 2 against the piston 6 to force air into the inflatable pocket. On attaining the required pressure in the inflatable pocket 12—and thus the required degree of grip against the instep—the skier repositions the valve 10 so as to connect the cylindrical chamber 5 with the cavity 16 thus blocking air flow to the pocket 12 while at the same time maintaining the pressure previously reached.

Thereafter, the bending movements made by the skier during use of the boot will result in air being fed to the cavity 16 which air then passes through the perforations in the insole 17 to ventilate and dehumidify the boot interior.

If the skier desires to slacken the grip exerted on his instep, he manipulates the discharge valve 13 to deflate the pocket 12.

From the foregoing, it is apparent that a ski boot according to the invention offers numerous advantages and in particular it allows elastic gripping of the instep, it allows the grip to be adjusted in a simple and comfortable manner and the attained degree of grip to be verified at any moment without kneeling, and it enables the boot interior to be ventilated and dehumidified during use.

In the modified embodiment shown in FIG. 2, a pneumatic plunger 18 is disposed within the cavity 16 beneath the rear portion of the insole 17. This plunger is connected by means of a tube 17 to a valve 10' having three outlets; namely, one outlet connected to the air pocket 12, one outlet connected to the plunger 18 and one outlet connected to atmosphere.

In operation of this embodiment, the skier positions the valve 10' so as to connect the cylindrical chamber 5 with the plunger 18. He then bends his leg so as to pump air from the chamber 5 to the plunger 18, thus causing the insole to rise. As a result of this rising movement, the foot rear and the instep are urged against the pocket 12.

The skier then positions the valve 10' so as to block the flow of air into the plunger and to connect the cylindrical chamber 5 to the pocket 12. He then bends his leg repeatedly to feed air into the pocket, as previously described.

The skier then positions the valve 10' so as to connect the cylindrical chamber 5 to atmosphere. By this means, any further bending movements have no effect on the boot. Alternatively, interior ventilation of the boot can be provided, as for the first described embodiment.

When the skier wishes to lower the insole, he operates a discharge valve (not shown on the drawings) analogous to the discharge valve 13.

The second embodiment has the advantage of enabling the skier to vary the inclination of the insole according to his requirements.

Inasmuch as the invention is subject to many variations, the embodiments described above should be regarded as merely illustrative of the invention, whose full scope is set out in the following claims.

I claim:

1. A rear-entry ski boot comprising in combination:

a foot portion, a leg portion pivotally connected to the foot portion, an inflatable air pocket inside the foot portion, and an air pump in fluid communication with said air pocket, said pump comprising a first part affixed to said first portion and a second relatively moveable part engaged by said leg portion, whereby foot flexure by a wearer of the boot displaces air from said pump to inflate said air pocket.

2. The invention recited in claim 1 wherein said pocket is positioned in a position corresponding to the instep of the wearer's foot.

3. The invention recited in claim 1 wherein the air pocket is positioned between the foot portion of the boot and the insole thereof.

4. The invention recited in claim 3 wherein the air pocket comprises a plunger adapted to lift the insole.

5. The invention recited in claim 1 wherein said pump comprises a cylindrical chamber with a piston slidable therein, said piston having a return spring and including a check valve.

6. The invention recited in claim 1 further comprising means defining a duct connecting said cylindrical chamber to said pocket, and valve means for shutting off air flow through said duct to said pocket.

7. The invention recited in claim 6 wherein said valve includes a further outlet for discharging the air to atmosphere.

8. The invention recited in claim 6 wherein the valve has a third outlet connecting said cylindrical chamber to a cavity defined between said foot portion and said insole, and wherein the insole is perforated to allow air flow therethrough.

9. The invention recited in claim 1, further comprising a shoulder on said leg portion, said shoulder substantially facing said second pump part to move said second pump part with respect to said first pump part.

10. The invention recited in claim 1 further comprising shoulder means engageable with said leg portion, said shoulder means substantially facing said piston and movable by the leg portion to reciprocate the piston.

* * * * *